United States Patent [19]

Laird et al.

[11] Patent Number: 4,641,438

[45] Date of Patent: Feb. 10, 1987

[54] ATHLETIC SHOE FOR RUNNER AND JOGGERS

[76] Inventors: Bruce A. Laird; Richard A. Laird, both of Box 169, R.D. #1, Northampton, Pa. 18067

[21] Appl. No.: 671,699

[22] Filed: Nov. 15, 1984

[51] Int. Cl.[4] ..... A43B 13/04; A43B 13/00

[52] U.S. Cl. ..... 36/59 C; 36/59 R; 36/32 R; D2/320

[58] Field of Search ..... 36/103, 25 R, 32 R, 36/31, 59 R, 59 A, 59 C, 28; D2/320

[56] References Cited

U.S. PATENT DOCUMENTS

| | | | |
|---|---|---|---|
| D. 119,291 | 3/1940 | Watanabe | D2/320 |
| D. 266,371 | 10/1982 | Stubblefield | D2/320 |
| 2,433,303 | 12/1947 | Spini | 36/59 C |
| 3,350,795 | 11/1967 | Schlecht | 36/55 |
| 3,785,646 | 1/1974 | Ruskin | 36/32 R |
| 4,283,865 | 8/1981 | Dassler | 36/59 C |
| 4,316,332 | 2/1982 | Giese et al. | 36/30 R |
| 4,402,146 | 9/1983 | Parracho et al. | 36/32 R |
| 4,439,936 | 4/1984 | Clarke et al. | 36/25 R |
| 4,445,286 | 5/1984 | Norton | 36/32 R |
| 4,501,077 | 2/1985 | Young | 36/25 R |
| 4,510,702 | 4/1985 | Ehrlich, Jr. | 36/31 |

FOREIGN PATENT DOCUMENTS

| | | | |
|---|---|---|---|
| 2618588 | 11/1977 | Fed. Rep. of Germany | 36/59 R |
| 357157 | 3/1938 | Italy | 36/32 R |
| 328731 | 3/1958 | Italy | 36/32 R |

*Primary Examiner*—Werner H. Schroeder
*Assistant Examiner*—Steven N. Meyers
*Attorney, Agent, or Firm*—Ruth Moyerman

[57] ABSTRACT

An athletic shoe for running is disclosed. The shoe has a tread design of triangular faced, slope-sided, prism-shaped, canted studs arranged in a pattern which limits and controls impact forces conducted to the foot. A set of triangular, prism-shaped stabilizer pins molded laterally into and across the outersole protects the metatarsal bones and helps to propel the foot into the next step. Tetrahedral lateral heel stabilizers control lateral roll of the ankle area and pyramidal buttress supports at the stabilizer end reduce impact shock to the metatarsal area. An interior sole further reduces impact forces and an interior lining directs perspiration away from the foot.

13 Claims, 12 Drawing Figures

FIG. 8
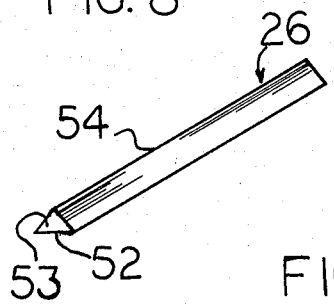
FIG. 5
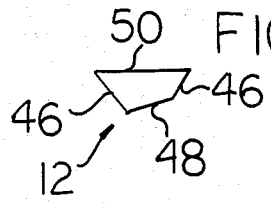
FIG. 6
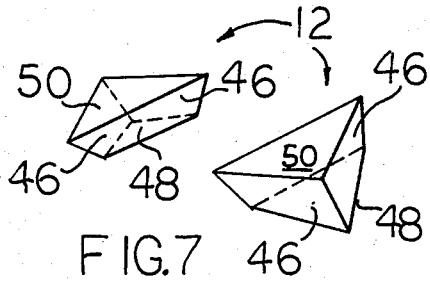
FIG. 7
FIG. 10
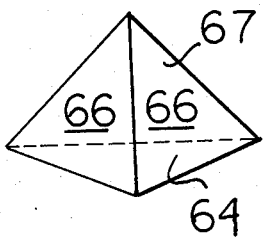
FIG. 11
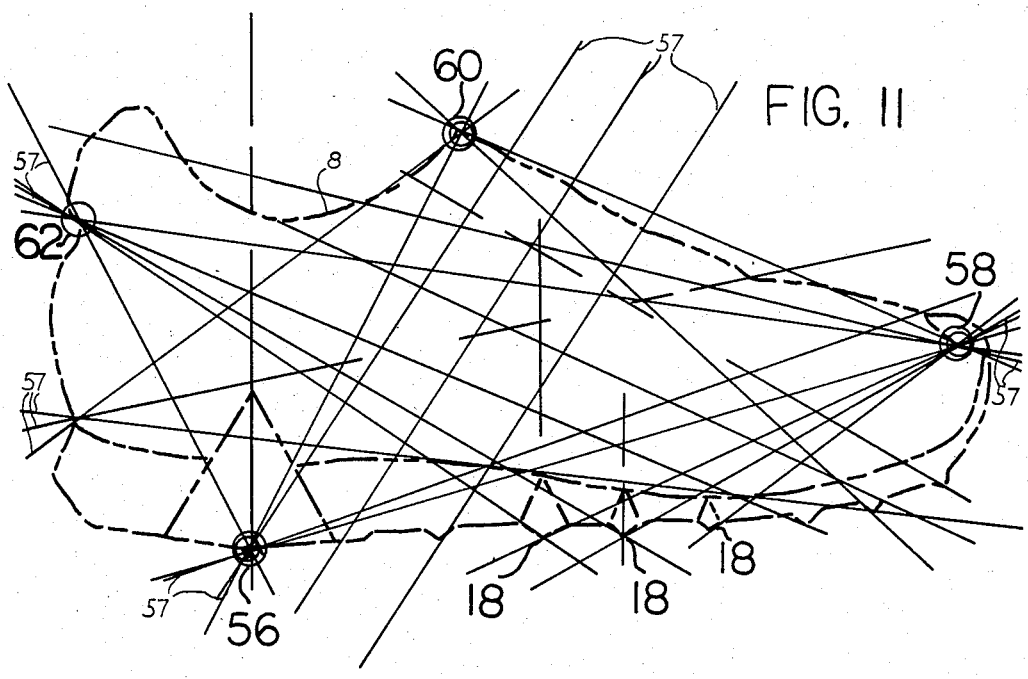

ATHLETIC SHOE FOR RUNNER AND JOGGERS

BACKGROUND OF THE INVENTION

1. Field of the Invention

This invention relates to athletic shoes, and in particular to shoes used for running where the user's body weight exceeds one hundred forty pounds.

2. Description of the Prior Art

In recent years, burgeoning interest in physical fitness and health has resulted in vast numbers of people pursuing running as a means of conditioning their bodies. Unfortunately, injuries to the joints, muscles, ligaments and tendons of the runner's lower extremeties has increased due in no small measure to ill-fitting and poorly designed running shoes. During contact of the running shoe with the running surface, a force of three to eight times body weight impacts on the runner's foot. The impact of the foot is absorbed by the running shoe or transmitted directly to the leg. The results of this impact on the foot and leg due to improperly designed shoes can be shin splints, muscle soreness, hamstring strains, stress fractures and sore knee joints.

Many devices have been proposed and patented over the years to improve the design and function of running shoes. U.S. Pat. No. 4,402,146 to Parracho et al discloses a running shoe sole with heel tabs to increase lateral stability and reduce ankle fatigue. U.S. Pat. No. 4,430,810 to Bente discloses an outer sole for sports shoes having adjustable sole fexibility in the heel region adaptable to the individual requirements of the runner and track. U.S. Pat. No. 4,364,188 to Turner et al discloses a running shoe with a rear stabilization means to decrease the tendency to overpronation.

Other patents of interest relating to athletic shoes include U.S. Pat. No. 4,235,026; U.S. Pat. No. 4,378,643; U.S. Pat. No. 4,255,877; U.S. Pat. No. 4,245,406; U.S. Pat. No. 4,128,950 and U.S. Pat. No. 4,307,521. Although these shoes ameliorate to some extent the effects of impact shock to the foot, they do not completely resolve the problems.

SUMMARY OF THE INVENTION

The aforementioned prior art problems are overcome by the athletic shoe of this invention. The shoe has an outer sole with a tread comprised of canted, triangular-faced, prism-shaped, slant-sided studs of varying sizes. These studs are arrayed around the bottom of the sole in a predetermined configuration to absorb the greatest impact and dissipate the shock away from the foot. This is made possible both because of the stud's prism-shaped configuration and the distribution pattern.

Resilient stabilizer pins, preferably of a Teflon type material and having a triangular prism configuration, are molded laterally, face down, into the metatarsal area of the outer sole to displace pressure on the metatarsal bones during the pronation phase of the foot in running, and to help correctly propel the foot correctly into its next step.

Tetrahedral-shaped buttress supports, attached preferably by molding, to the ends of the stabilizer pins at the outer sole side direct the foot's impact shock away from the metatarsal area.

A lateral stabilization means comprising two tetrahedral-shaped tabs, one each attached to the sides of the outer sole heel area controls the amount of lateral roll of the runner's ankle and reduces the stress transmitted thereby to the ankle and knee joints.

A second sole (not to be confused with the conventional innersole) of a resilient polymer such as polyurethane, is provided to reduce impact shock to the foot when the outer sole strikes the running surface.

Lastly, a lining in the upper shoe interior of natural or synthetic materials allows the perspiration of the foot to evaporate more efficiently and also modulates against overpronation of the foot.

It is therefore an object of this invention to provide a running shoe which, by means of a tread design and tread displacement, absorbs and dissipates impact shock from the running surface away from the foot.

It is another object of this invention to provide a shoe with stabilizer pins molded laterally into and across the outer sole metatarsal area to protect the metatarsal bones from impact forces entering in the pronation phase. Additionally, the pins aid the foot as it propels into the next step.

It is still another object of this invention to provide a buttress support system proximate the ends of the stabilizer pins which directs shock away from the metatarsal bones.

It is yet another object of this invention to provide a lateral stabilization means on each shoe side in the outer sole heel area which controls lateral roll motion and relieves stress on the ankle and knee joints.

It is yet another object of this invention to provide, through a natural or synthetic upper shoe lining, an efficient perspiration evaporation to control overpronation and over flexing of the foot, thereby maintaining a normal and natural form of the foot; to give support to the metatarsal bone structure, thereby maintaining a natural form of the foot under pressure; and to stabilize and control the amount of pressure placed on the metatarsal bone structure.

It is still a further object of this invention to provide an auxiliary interior sole of a resilient polymer to absorb shock transmitted from the outer sole to the shoe interior.

These and other objects will be more readily ascertainable to one skilled in the art by reference to the accompanying drawings and exemplary embodiments that follow.

BRIEF DESCRIPTION OF THE DRAWING(S)

FIG. 5 is a side elevation of a stud.

FIG. 6 is a tilted isometric view of a stud.

FIG. 7 is yet another tilted isometric view of a stud.

FIG. 8 is an enlargement of a stabilizer pin.

FIG. 10 is an enlargement of the buttress supports.

FIG. 11 is a side elevation of the shoe in phantom showing vectors used to pinpoint the stress epicenters and to show placement and outward extension of the buttress supports and lateral stabilizer.

DETAILED DESCRIPTION OF THE PREFERRED EMBODIMENT(S)

Figure 1:
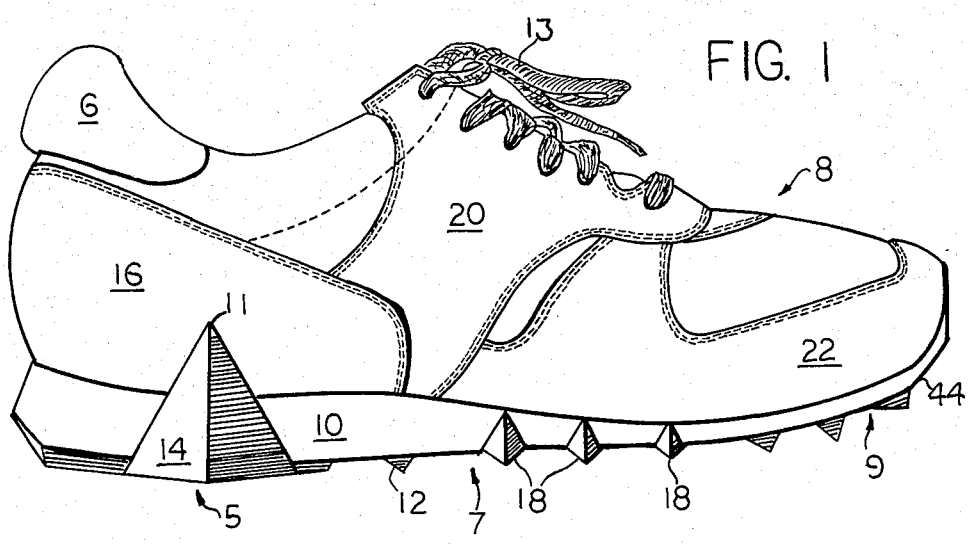
FIG. 1 is a side elevation of the athletic shoe of this invention.

Referring now to FIG. 1, shoe 8 includes outer sole 10, shown with tread studs 12 extending downward. Pyramidial lateral stabilizer 14 (one of a pair) is shown as a tab mounted to the outside edge of outersole 10 proximate heel area 5 with apex 11 extended upward to heel counter 16. Pyramidial buttress supports 18 are shown attached to the outside edge of outer sole 10 proximate the metatarsal, or midstance, area 7. Show upper 20 is covered with conventional synthetic material which is reinforced in the toe box area 22 and heel counter area 16.

Also shown are conventional Achilles pad 6 and ties 13. Lastly, sole toe-off area 9 is shown which, together with heel area 5 and midstance area 7, are reference areas for placement of studs 12, as will be explained in reference to FIG. 2.

Figure 2:
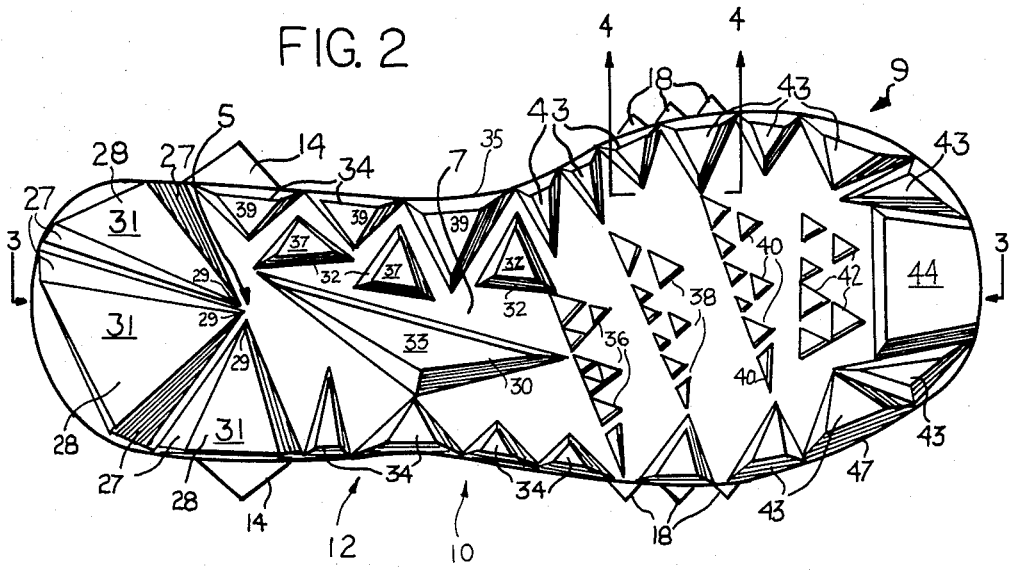
FIG. 2 is a bottom elevation of the device showing the stud design and tread configuration.
Figure 12:
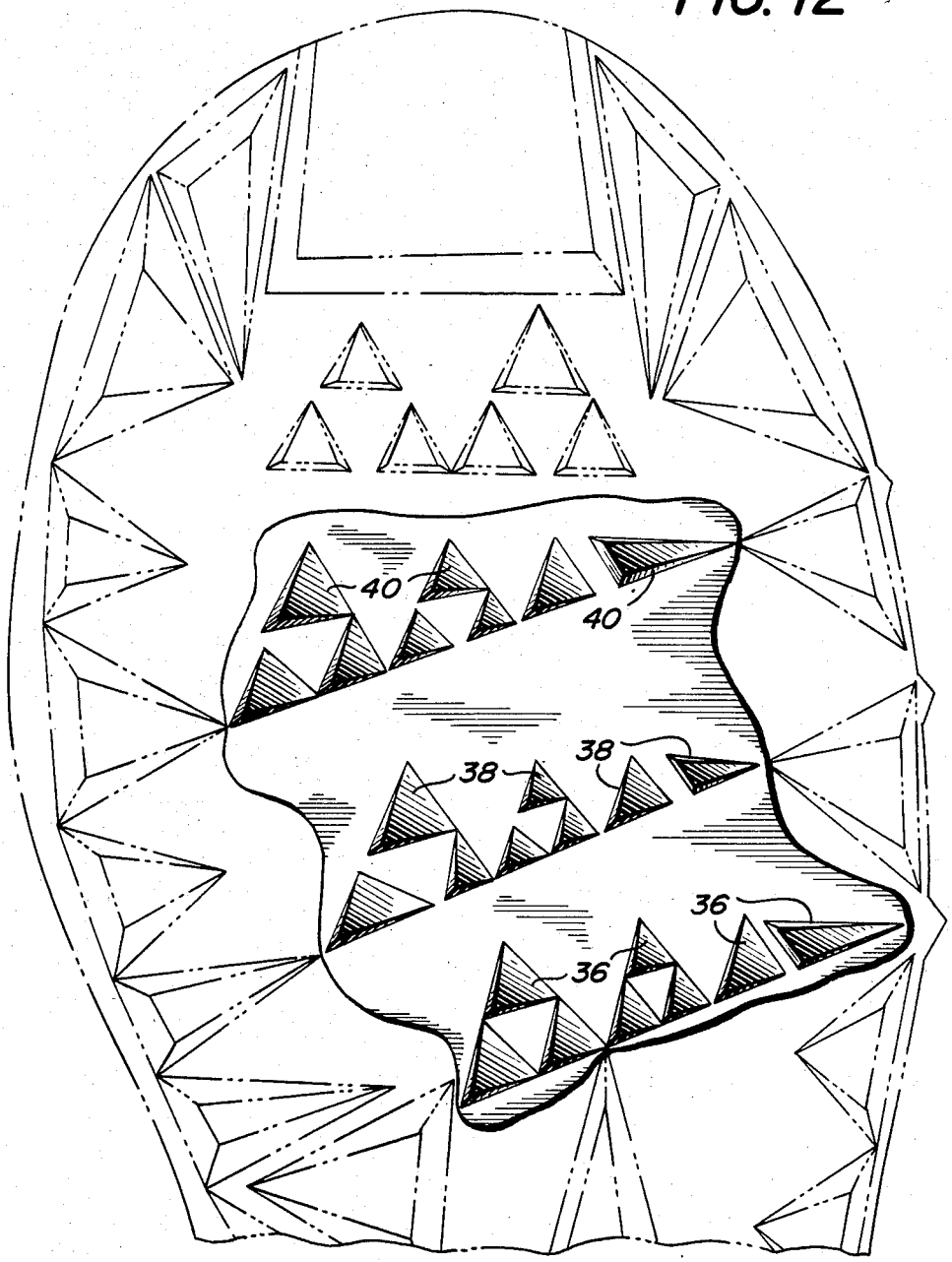
FIG. 12 is a partial enlarged view of FIG. 2.

Referring now to FIG. 2 and FIG. 12, the bottom area of outer sole 10 is shown with studs 12 arranged in a predetermined pattern to form the ground contacting part of the tread. Referring first to heel area 5, three circumferential heel studs 28 generally cover heel area 5 with their apexes 29 converging at the forward center of heel area 5. Faces 31 of heel studs 28 are canted inward toward apex 29. Heel studs 28, and all other studs as well, are also shown with sloped sides 27 which give the pyramidial or five-faced down configuration which is shown more clearly in FIGS. 5 and 6.

Forward of heel area 5 is midstance area 7. Midstance area 7 includes three sets of studs. A single elongated, longitudinally disposed stud 30 is shown as the only member of the first set. Its face 33 is canted twoard shoe inside edge 35. Three arch studs 32 and seven midstance circumferential studs 34 comprise set two. Arch studs 32 are positioned adjacent elongated stud 30 and generally between opposed circumferential studs 34 proximate the inside of sole 10. Faces 37 of arch studs 32 are canted toward adjacent circumferential studs 34. Faces 39 of circumferential stud 34 cant inward toward adjacent arch studs 32. Set three of midstance studs is comprised itself of three sets of studs—lateral midstance studs alpha 36, beta studs 38 and gamma studs 40 are positioned in the metatarsal area 23 of sole 10. The midstance studs are all canted toward shoe outside edge 47.

Lastly, a set of lateral studs 42 and eleven toe area circumferential studs 43 are located in toe-off area 9 and a single truncated pyramid shaped stud 44 is located in the front of the tread with its apex extending around into toe box 22 (see FIG. 1).

Also shown in FIG. 2 are lateral stabilizers 14 which extend outward from outer sole 10 and buttress supports 18 which also are shown extending outward from outer sole 10.

Figure 3:
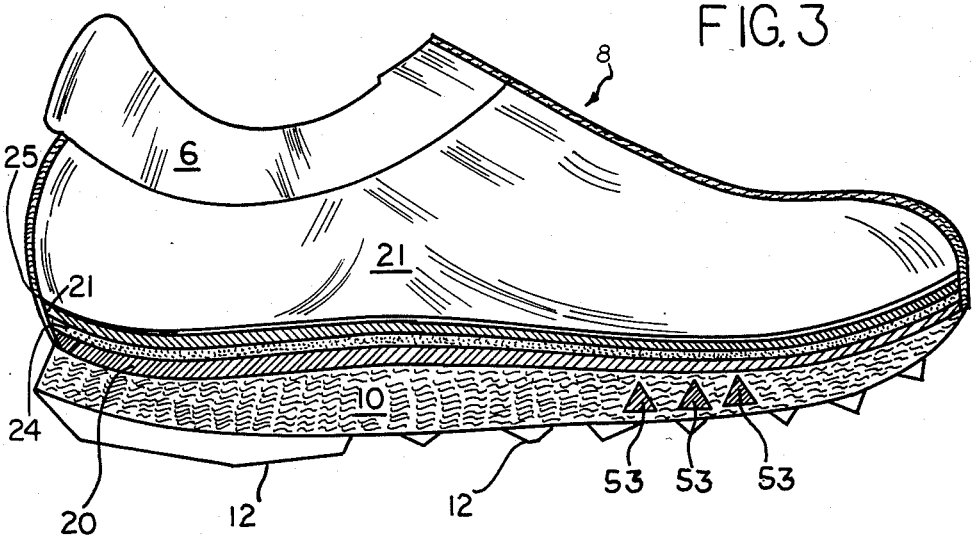
FIG. 3 is a longitudinal cross section of the device showing the interior shoe construction taken on lines 3—3 of FIG. 2.

Referring now to FIG. 3 which is a cross section taken on lines 3—3 of FIG. 2, outer sole 10 is again shown having studs 12 extending downward. The bottoms of studs 12 are not parallel to the shoe bottom but are slightly canted as explained previously and also as shown again in FIGS. 4 and 5. Ends 53 of stabilizer pins 26 are shown extending laterally through outer sole 10. Their exact placement, as well as buttress supports 18, is extremely important and is predetermined as will be shown in reference to FIG. 9.

Figure 4:
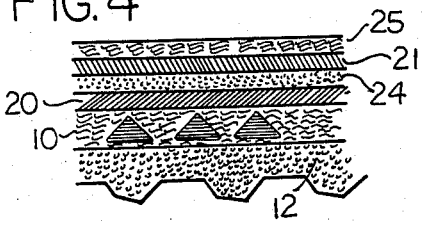
FIG. 4 is a cross section taken on lines 4—4 of FIG. 2.

FIGS. 3 and 4 together show the layers of materials of shoe 8 as they are disposed under the foot. Beginning with outsole 10, shoe upper 20 and then interior sole 24 are positioned above outer sole 10. Both extend from the heel area to the toe area. Next in upward order is interior lining 21 which is preferably a natural skin, although synthetic material could be substituted so long as it gives the equivalent absorbent quality. FIG. 3 shows also that the shoe 10 is constructed so that lining 21 wraps around the foot except for a thin conventional foot pad 25.

Referring now to FIG. 5, an individual and representative stud 12 is shown in side view having sloped sides 46, stud face 48 which is shown canted (or sloped) and which is the face which contacts the running surface, and base 50 which joins outer sole 10.

Referring now to FIGS. 6 and 7, stud 12 is shown from a top view in FIG. 6 having sloped sides 46, stud face 48 which contacts the running surface, and base 50 which interfaces with outer sole 10. In FIG. 7, stud 12 is shown tilted from another angle having sloped sides 46, stud face 48 and stud base 50.

FIG. 8 shows more clearly the prismatic configuration of stabilizer pin 26 including base 52, apex 54 and end 53.

Figure 9:
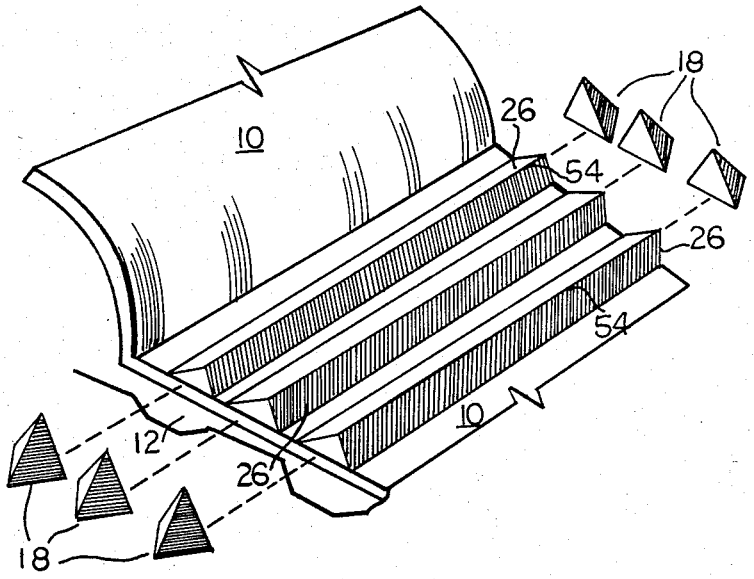
FIG. 9 shows a top peel-back fragmentary view of the outer sole exposing the stabilizer pins. The buttress supports are shown in exploded view.

Referring now to FIG. 9, a peel-back of a partial view of sole 10 shows the three stabilizer pins 26 in place. In FIG. 9, outer sole 10 is shown peeled back at the longitudinal cross section of sole 10 where stabilizer pins 26's apex 54 lies. When studs 12 impact the running surface, the impact force is conducted to stabilizer pin base 52 from apex 54, and from there both to the sole and also outward to buttress supports 18 (shown exploded in this view). Buttress supports 18 aid in dissipating the impact force away from stabilizer pins 26 and therefore away from the user's foot.

Referring now to FIG. 10, buttress support 18 is shown having base 64. Sides 66 indicate the surface of the prism along which the impact force is dissipated. Rear face 67, visible in this view, abuts the shoe.

The tetrahedral configuration of lateral stabilizers 14 and buttress supports 18, the pyramidial configuration of tread studs 12 and the triangular configuration of stabilizer pins 26 are extremely important. These shapes and configurations act to spread the impact shock over a greater area of the foot. This dissipation phenomena is due to the mathematically proven relationships inherent in triangles and pyramids, etc. wherein force or stress at the apex travels in downward and outward vectors and is therefore dissipated over the larger base area.

FIG. 11 shows the major design parameter points of the shoe construction. Point 56 indicates the main contact point of outer sole 10 with the running surface which locates lateral stabilizer 14. Point 58 indicates the forward end point of toe box 22 and single stud 44. Point 60 locates the position of shoe upper 20 lace grid. Point 62 locates the top of heel counter 16. By extending vectors, variously 57, from these primary points, the location of other necessary components are sited including buttress supports 18.

There are many variations which may be practiced within the scope of this invention. Although stabilizer pins 26 are preferably made of Teflon, other resilient materials may be used so long as they are lightweight, but have strength and flexibility characteristics.

Interior sole 24 is preferably formed of EVA polyurethane, but other similar materials may be used. The outer shoe upper construction is conventional and forms no part of this invention. Any materials now in common use are satisfactory. Likewise, laces on shoe upper 20 may be replaced with Velcro fasteners. Interior lining 20 may be manmade or of natural fiber material but natural animal skin is preferred.

The sole of this invention has many advantages. Chief among these is that the shoe tread configuration of studs absorbs and dissipates impact shock from contact of the shoe tread with the running surface.

Secondly, the stabilizer pins absorb and direct impact shock away from the metatarsal bones and help propel the foot into the next step.

Thirdly, the lateral stabilizers control lateral foot roll and thereby aleviate stress placed on the ankle and knee joints.

Fourthly, the pyramidal buttress supports dissipate impact shock and support the metatarsal bones.

Fifthly, the interior sole reduces and absorbs impact shock conducted from the outer sole towards the foot.

Lastly, the interior lining directs perspiration away from the foot and helps to control overpronation of the foot.

Overall, the shoe is especially useful to the overweight and underconditioned runner which is the runner most likely to be injured.

Having now illustrated and described my invention, it is not intended that such description limit this invention, but rather that the invention be limited only by a reasonable interpretation of the appended claims.

What is claimed is:

1. In an athletic shoe intended for runners having a body weight exceeding one hundred forty pounds having a shoe upper covering, an interior sole, a shoe upper, a heel counter and a toe end including a toe box, an elastomeric outer sole including a heel area, a midstance and a toe-off area and an outer sole outside edge and inside edge, the improvement comprising an outer sole formed of resilient material having thereon a plurality of triangular faced, slope sided, prism shaped, canted studs distributed circumferentially around and laterally and longitudinally thereon, said outer sole bottom in a predetermined configuration including three circumferential studs in the heel area and wherein said three heel studs are oriented and canted so that the apexes of each of their triangular faces converge proximate said heel areas' forward center and wherein said three heel studs are sized to substantially cover said heel area to maximize the displacement of impact force when a runner's heel touches the ground, said predetermined configuration also including three sets of studs in said midstance area, said first midstance area set comprising a single elongated, longitudinally disposed stud oriented to receive the impact of the runner's foot when it touches ground in the pronation phase of impact, and wherein said longitudinal studs triangular face is canted toward the shoe's inside edge, said second midstance area set comprising three arch studs longitudinally disposed with respect to each other throughout said sole's arch area and interspersed between opposed facing, circumferential studs and said elongated studs, said arch studs being canted toward said adjacent circumferential opposed studs and said circumferential studs being canted toward adjacent arch studs, said third set of midstance studs comprising an alpha, beta and gamma row of lateral metatarsal studs, said rows being generally parallel to each other with said metatarsal stud's triangular faces being canted toward said sole outside edge.

2. The athletic shoe according to claim 1 wherein there are two sets of lateral studs in said toe-off area to give the foot traction, propulsion and lift-off, said first set comprising two side-by-side groups of three studs each, each of said groups of three studs forming a triangular configuration, apex oriented and canted toward said toe end of said shoe, said second toe-off set comprising a single, truncated pyramid-shaped toe box stud.

3. The athletic shoe according to claim 1 comprising, additionally, three resilient stabilizer pins, said pins each having a triangular prism configuration and wherein said pins are disposed laterally and coextensively through the metatarsal area of said outer sole, one each at generally the cuneiform, metatarsal and phalanges area of the foot, said pins being oriented so that a face of said prism opposes said outer sole, said pins thereby maximizing dissipation of foot contact shock at these areas.

4. The athletic shoe according to claim 3 comprising, additionally, six buttress supports, said supports each having a tetrahedral configuration, one face on said support being attached to an exterior surface of each of said stabilizer pins with said tetrahedron apex being vertically oriented upward from said outer sole and a tetrahedron face being in a plane generally parallel with said outer sole, said supports decreasing in size from heel area to toe-off area.

5. An athletic shoe according to claim 3 wherein said stabilizer pins are comprised of resilient polymer.

6. An athletic shoe according to claim 3 wherein said said outer sole is molded together with said stabilizer pins.

7. The athletic shoe according to claim 1 comprising, additionally, a pair of lateral stabilization means, said means having a tetrahedral configuration with one face of one of said tetrahedrons each attached to opposing sides of said shoe at the outer sole heel area with said tetrahedron apex vertically oriented upwards from said sole and said stabilizer being joined to said heel counter so that a face of said tetrahedron is generally parallel with said outer sole.

8. An athletic shoe according to claim 7 wherein said lateral stabilization means is vulcanized to said outer sole and said heel area.

9. The athletic shoe according to claim 1 comprising, additionally, an interior lining, said lining covering generally interior surfaces of said shoe upper contacting the wearer's foot, to modulate the foot contour and enhance perspiration evaporation.

10. The athletic shoe according to claim 9 comprising, additionally, an interior sole, said interior sole being positioned between said shoe outer covering and said shoe interior lining and formed from ethylene vinyl acetate polyurethane.

11. An athletic shoe according to claim 9 wherein said interior lining is comprised of animal skin.

12. An athletic shoe according to claim 9 wherein said interior lining is comprised of synthetic fibers.

13. In an athletic shoe intended for runners having a body weight exceeding one hundred forty pounds, having an outer sole, an interior sole and a shoe upper, the improvement comprising:

(a) an elastomeric outer sole including a heel and metatarsal area, said sole formed of resilient material and having a plurality of triangular faced, prism-shaped canted studs arcuately and laterally distributed around said sole bottom in a predetermined configuration to absorb and dissipate impact shock entering through said outer sole when said studs contact a running surface;

(b) a plurality of resilient stabilizer pins, said pins having a triangular prism configuration and wherein said pins are disposed laterally and coextensively through the metatarsal area of said outer sole, said pins being oriented so that a face of said prism opposes said sole, said pins thereby providing maximum dissipation of contact shock;

(c) buttress supports, said supports having a tetrahedral configuration, one face of said support being attached to an exterior surface of said stabilizer pins with said tetrahedron apex being vertically oriented upward from said sole and a tetrahedron face being in a plane parallel with said outer sole;

(d) a pair of lateral stabilization means, said means having a tetrahedral configuration with one face of one of said tetrahedrons each attached to opposing sides of said outer sole heel area with said tetrahedron apex vertically oriented upwards from said sole and said stabilizer being joined to said shoe upper heel counter so that a face of said tetrahedron is generally parallel with said outer sole;

(e) an interior sole, said interior sole being positioned between said shoe outer covering and said shoe interior lining and formed from ethylene vinyl acetate polyurethane; and, (f) an interior lining, said lining covering generally all interior surfaces of said upper shoe contacting the wearer's foot, to modulate the foot contour and enhance perspiration evaporation.

* * * * *